United States Patent [19]

Fischer

[11] 4,160,337

[45] Jul. 10, 1979

[54] HOLLOW STRUCTURAL ELEMENT FOR ASSEMBLING A STRUCTURE

[76] Inventor: Artur Fischer, Weinhalde 34,, D-7244 Waldachtal Tumlingen, Fed. Rep. of Germany

[21] Appl. No.: 827,310

[22] Filed: Aug. 24, 1977

[30] Foreign Application Priority Data

Sep. 11, 1976 [DE] Fed. Rep. of Germany ... 7628472[U]

[51] Int. Cl.[2] ..... A63H 33/08

[52] U.S. Cl. ..... 46/26

[58] Field of Search ..... 46/17, 25, 26

[56] References Cited

U.S. PATENT DOCUMENTS

| | | | |
|---|---|---|---|
| 2,249,060 | 7/1941 | Stone | 46/25 |
| 3,224,135 | 12/1965 | Wright et al. | 46/17 |
| 3,496,670 | 2/1970 | Sloop et al. | 46/25 |
| 3,576,936 | 5/1971 | Fischer | 46/26 X |
| 3,701,214 | 10/1972 | Sakamoto | 46/25 |

*Primary Examiner*—F. Barry Shay
*Attorney, Agent, or Firm*—Michael J. Striker

[57] ABSTRACT

A hollow structural element for assembling a structure, has a hollow body part having an open side and being provided with means for connecting the body part with another structural element, and a cover insertable in the body part through the open side thereof. The cover is provided with at least one connecting element for connecting the same with a further structural element. The connecting element projects outwardly beyond a side margin of the cover and thereby forms a stop preventing the cover from excessive movement inwardly of the open side of the body part. Two such connecting elements may be arranged on the cover. The body part and the cover may be cup-shaped. The connecting means of the body part may be formed as undercut grooves and elongated undercut members. The connecting elements of the cover may also be formed as elongated undercut members.

7 Claims, 1 Drawing Figure

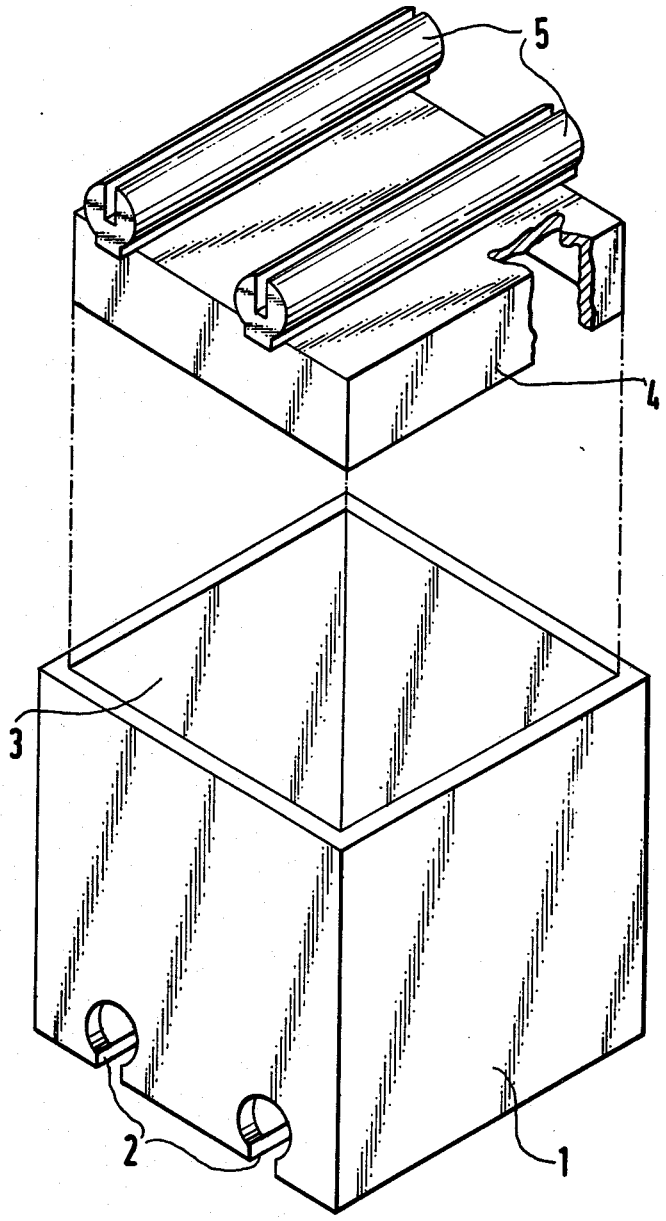
5
4
3
2
1

HOLLOW STRUCTURAL ELEMENT FOR ASSEMBLING A STRUCTURE

BACKGROUND OF THE INVENTION

The present invention relates to a hollow structural element for assembling a structure. More particularly, it relates to a hollow structural element which has a body part provided with connecting means, and a cover for closing the open side of the body part.

Hollow structural elements have often been used in toy models as terminal parts which imitate containers, particularly for assembling toy trucks, cars and the like. Such hollow structural elements are provided with connecting means for connecting the same with other structural elements. In many cases, it is desirable to connect the hollow structural element with a still further structural element. For this purpose, the above hollow structural element of the known construction has been closed with a cover provided with further connecting means. However, the cover positioned on the hollow structural element changes the dimensions of this element which is very undesirable in assembling the structure.

SUMMARY OF THE INVENTION

Accordingly, it is an object of the present invention to provide a hollow structural element for assembling a structure which avoids the disadvantages of the prior art structural elements.

More particularly, it is an object of the present invention to provide a hollow structural element having an open side, which imitates a container of a toy model and can be connected with another structural element at the open side thereof, without changing the dimensions of the hollow structural element.

In keeping with these objects, and with others which will become apparent hereinafter, one feature of the present invention resides, briefly stated, in a hollow structural element which has a body portion having an open side and provided with connecting means for connecting the body part with another structural element, and a cover insertable into said body part through the open side thereof and provided with at least one connecting element for connecting the cover with a further structural element. The connecting element of the cover projects outwardly beyond a side margin thereof and forms a stop preventing the cover from excessive movement inwardly of the open side of the body part.

When the hollow structural element is constructed as above, the cover is fully inserted into a hollow of the hollow structural element so that an upper surface of the cover is flush with an upper surface of the hollow structural element. The cover does not change the height of the hollow structural element so that the latter has substantially the same dimensions as it had prior to the insertion of the cover therein. At the same time, the cover cannot be excessively inserted into the hollow of the hollow structural element. The connecting element projecting outwardly beyond the side margin of the cover, abuts against the upper surface of the hollow structural element and prevents the above undesirable excessive movement. A playing child can easily insert the cover in the hollow structural element, which cover enables the child to connect the thus produced structure with a further structural element. The latter can be connected to the structure by means of the connecting element arranged on the cover. In order to retain the cover in the hollow of the hollow structural element against pulling out of the latter, it suffices to insert the cover in the body part with snap action so as to firmly clamp the cover in the body part of the structural element.

Another feature of the present invention is that the connecting element of the cover projects outwardly beyond two opposite side margins of the cover. At the same time, two such elongated connecting elements may be provided which are spaced from one another in a direction transverse to the direction of elongation thereof.

Still another feature of the present invention is that the connecting means of the body part of the hollow structural element may include undercut grooves and elongated undercut members insertable in the grooves. The connecting elements of the cover may be formed as elongated undercut members.

A still further feature of the present invention is that the body part and the cover of the hollow structural element are cup-shaped. Preferably, the cover is inserted into the body port so that a hollow of the cover faces towards the hollow of the body part.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWING

The single FIGURE of the drawing is a perspective view showing a hollow structural element in accordance with the present invention.

DESCRIPTION OF THE PREFERRED EMBODIMENT

A hollow structural element for assembling a structure in accordance with the present invention is shown in the single FIGURE of the drawing.

The structural element has a hollow body part 1 provided with connecting means for connecting the body part with another structural element. The above connecting means include two undercut grooves 2 which are formed in a lower portion of the body part 1 and have a cross-section increasing in the direction towards the interior of the body part. Undercut elements of the other structural element can engage in the undercut grooves of the body part 2 so as to connect both structural elements with one another. Each of the grooves 2 has a circular enlarged portion formed in a side wall of the body part 1 as a continuation of the increased cross-section of the respective groove. The circular enlarged portions of the grooves 2 serve for receiving axles therein.

It is understood that the body part 1 may be provided with a different number of grooves. It is possible to provide only one groove or more than two such grooves in the lower portion of the body part 1. The body part 1 is cup-shaped and has an opening 3 formed in an upper portion thereof.

The structural element further has a cover 4 whose dimensions and contour correspond to the transverse dimensions and contour of the opening 3 of the body part 1, so that the cover can be inserted in the latter. In order to save material, the cover 4 may also be cup-shaped and have an inner hollow. The cover, as shown in the drawing, has a lower surface facing towards the hollow of the body part 1 and an upper surface upwardly spaced from the lower surface.

Two elongated connecting elements 5 are mounted on the upper surface of the cover 2. Each of the connecting elements 5 has a length exceeding the respective transverse dimension of the cover and is so mounted on the latter that the connecting element projects outwardly beyond both side margins of the cover 4. It is understood that the cover may be provided with a different number of the connecting elements 5. It is possible to mount only one connecting element or more than two connecting elements on the upper surface of the cover 4. On the other hand, the connecting elements must not project outwardly beyond both of the side margins. It is possible that one of the connecting elements projects outwardly beyond one side margin, whereas the other connecting element projects outwardly beyond the other side margin.

For assembling a structure, a playing child inserts the connecting elements of another structural element in the grooves 2 of the body part 1 of the structural element which is shown in the drawing. Thus, the two structural elements are connected with one another. When the playing child wishes to further increase the structure by connecting a further structural element to the thus-formed structure, he or she inserts the cover 4 into the body part 1 of the shown structural element through the opening 3 of the body part 1 thereof. The projecting end portions of the connecting elements 5 of the cover 4 abut against the upper surface of the body part 1 and prevent the cover 4 from excessive movement inwardly of the opening 3 of the body part 1. The cover 4 is so located relative to the body part 1 that the upper surfaces of both elements are flush with one another. Therefore, the height of the body part 1 is not increased and the dimensions of the structural element are not changed.

It will be understood that each of the elements described above, or two or more together, may also find a useful application in other types of constructions differing from the types described above.

While the invention has been illustrated and described as embodied in a hollow structural element for assembling a structure, it is not intended to be limited to the details shown, since various structural changes and modifications may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hollow structural element for assembling a structure, comprising a hollow body part having one end face and a hollow which extends in one direction and has an open end at said one end face, said hollow body part further having another end face and being provided with at least one undercut groove in the other end face, for connecting said body part with another structural element; a separate cover which is not connected with said body part and has dimensions in two opposite directions transverse to said one direction, corresponding to those of said hollow of said body part so that said cover is connectable to said body part by being fully inserted into said hollow of said body part by movement in said one direction through said open end, said cover having a first surface facing toward said hollow of said body part and a second surface facing away from the latter; and at least one elongated undercut projection arranged on said second surface of said cover and extending in one of said transverse directions over the entire cover member and projecting outwardly beyond a side margin of the latter so as to abut against said one end face of said body part when said cover is fully inserted in said hollow of said body part, whereby said elongated projection simultaneously can connect said cover to a further structural element and prevents said cover from excessive movement inwardly of said open end of said hollow of said body part.

2. The hollow structural element as defined in claim 1, wherein said elongated projection is bar-shaped.

3. The hollow structural element as defined in claim 1, wherein said cover has a further side margin spaced from said first-mentioned side margin in said one transverse direction, said elongated projection projecting outwardly beyond said further side margin of said cover.

4. The hollow structural element as defined in claim 1, and further comprising another such elongated projection spaced from said first-mentioned elongated projection in the other of said transverse directions.

5. The hollow structural element as defined in claim 1, wherein said body part is cup-shaped.

6. The hollow structural element as defined in claim 1, wherein said cover is cup-shaped.

7. The hollow structural element as defined in claim 5, wherein said cover is cup-shaped and has a further hollow which faces towards said hollow of said body part when said cover is inserted in the latter.

* * * * *